US005380195A

United States Patent [19]

Reid et al.

[11] Patent Number: 5,380,195

[45] Date of Patent: Jan. 10, 1995

[54] PORTABLE SAFETY FLARE FOR COMBUSTION OF WASTE GASES

[76] Inventors: Brian Reid, 5507-52B Avenue, Rocky Mountain House, Alberta, Canada, T0M 1T0; Wendyle Jones, R.R. #2, Rocky Mountain House, Alberta, Canada, T0M 1T0

[21] Appl. No.: 164,550

[22] Filed: Dec. 10, 1993

[51] Int. Cl.[6] ..... F23D 14/00

[52] U.S. Cl. ..... 431/202

[58] Field of Search ..... 431/202

[56] References Cited

U.S. PATENT DOCUMENTS

| | | | |
|---|---|---|---|
| 3,658,482 | 4/1972 | Evans et al. | 23/277 C |
| 4,243,376 | 1/1981 | Cambell et al. | 431/202 |
| 4,255,120 | 3/1981 | Straitz, III | 431/202 |
| 4,269,583 | 5/1981 | Straitz, III | 431/202 |
| 4,516,932 | 5/1985 | Chaudet | 431/202 |
| 4,799,878 | 1/1989 | Schaeffer | 431/202 |
| 4,802,432 | 2/1989 | Pennington | 110/233 |
| 4,975,042 | 12/1990 | Schwartz et al. | 431/5 |
| 5,253,596 | 10/1993 | Bono Coraggioso | 110/211 |

*Primary Examiner*—Carroll B. Dority
*Attorney, Agent, or Firm*—Anthony R. Lambert

[57] ABSTRACT

A safety flare for combustion of waste gases is described which includes a container having an interior and an exterior. The interior is defined by a bottom and peripheral sidewalls. A vent stack extends through the interior of the container. The vent stack has a first end and a second end. The first end communicates with the exterior of the container adjacent the bottom. The second end extends past a top peripheral edge of the peripheral sidewalls of the container. Means is provided for permitting the communication of combustion air with the first end of the vent stack. A burner is positioned immediately surrounding the second end of the vent stack such that the burner is supplied with combustion air by the vent stack. The burner has a plurality of downwardly directed nozzles such that liquids passing through the nozzles fall by force of gravity into the interior of the container. This safety flare is intended to replace flare stacks and flare pits formerly used in the oil and gas industry.

6 Claims, 1 Drawing Sheet

PORTABLE SAFETY FLARE FOR COMBUSTION OF WASTE GASES

The present invention relates to a portable safety flare for the combustion of waste gases

BACKGROUND OF THE INVENTION

The use of flares for the safe disposal through combustion of waste gases is well known. It has been discovered, however, that environmental problems are associated with the use of flares when liquids are mixed in with the waste gases. When the safety flare is configured in the form of a flare stack, fine droplets of liquid are sprayed over vegetation in the surrounding countryside. When the safety flare is configured in the form of a flare pit, a contaminated residue is left in the ground from the liquid.

SUMMARY OF THE INVENTION

What is required is a safety flare for the combustion of waste gases that includes means for containing liquids.

According to the present invention there is provided a safety flare for combustion of waste gases which includes a container having an interior and an exterior. The interior is defined by a bottom and peripheral sidewalls. A vent stack extends through the interior of the container. The vent stack has a first end and a second end. The first end communicates with the exterior of the container adjacent the bottom. The second end extends past a top peripheral edge of the peripheral sidewalls of the container. Means is provided for permitting the communication of combustion air with the first end of the vent stack. A burner is positioned immediately surrounding the second end of the vent stack such that the burner is supplied with combustion air by the vent stack. The burner has a plurality of downwardly directed nozzles such that liquids passing through the nozzles fall by force of gravity into the interior of the container.

A lot of research went into the development of the safety flare as described. Initially, a container was constructed with a burner disposed about the peripheral sidewalls. The nozzles of the burner were directed downwardly to promote liquids falling by force of gravity into the container. It was discovered, however, that the burner gave off an intense heat which resulted in a deterioration of the condition of the container. The burner was then moved away from the sidewalls of the container, but problems were encountered with ensuring that the burner was supplied with sufficient combustion air to have a "clean" burn. A black sooty build up in the container was the result, especially when an annular shroud was placed upon the container to enhance liquid containment. The addition of a vent stack, with the burner configured around the vent stack resulted in an efficiently operating safety flare to which other features could then be added to enhance its operation.

Although beneficial results may be obtained through the use of the safety flare, as described above, liquid containment is, of course, enhanced when the container is a closed one. Even more beneficial results may, therefore, be obtained when a shroud extends from the top peripheral edge of the container to the burner.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
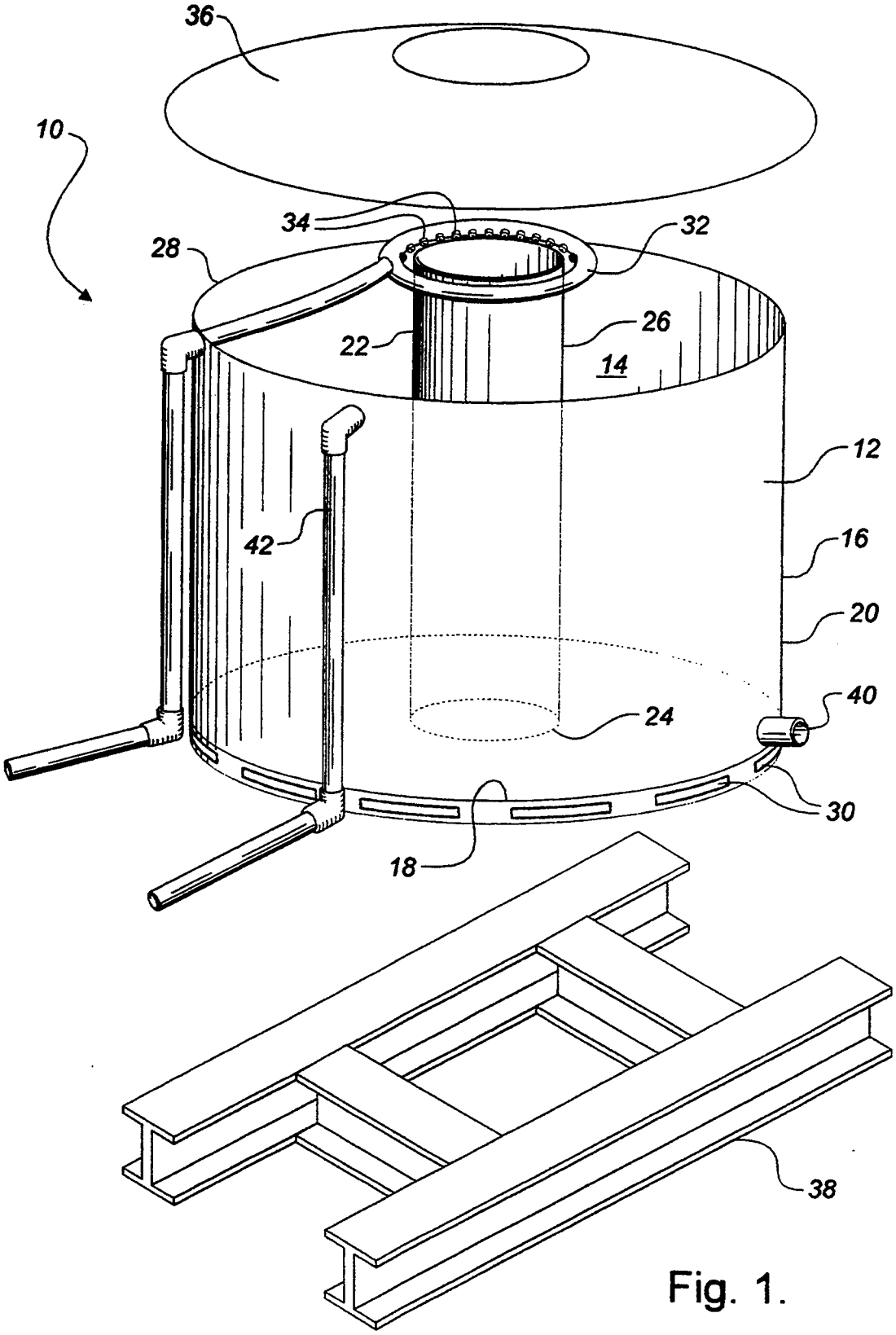
FIG. 1 is an exploded perspective view of a safety flare constructed in accordance with the teachings of the present invention.

The preferred embodiment, a safety flare for combustion of waste gases generally identified by reference numeral 10, will now be described with reference to FIG. 1.

Safety flare 10 includes a container 12 having an interior 14 and an exterior 16. Interior 14 is defined by a bottom 18 and peripheral sidewalls 20. A vent stack 22 extends through interior 14 of container 12. Vent stack 22 has a first end 24 and a second end 26. First end 24 communicates with exterior 16 of container 12 adjacent bottom 18. Second end 26 extends past a top peripheral edge 28 of peripheral sidewalls 20 of container 12. A plurality of vents 30 positioned adjacent bottom 18 serve as means for permitting the communication of combustion air with first end 24 of vent stack 22. A ring-form burner 32 is positioned immediately surrounding second end 26 of vent stack 22, such that burner 32 is supplied with combustion air by vent stack 22. Burner 32 has a plurality of downwardly directed nozzles 34 such that liquids passing through nozzles 34 fall by force of gravity into interior 14 of container 12.

In order to enhance operation safety flare 10 includes a number of additional features. A shroud 36 extends from top peripheral edge 28 of container 12 to burner 32. Shroud 36 enhances liquid containment. Container 12 is mounted on a skid assembly 38. Skid assembly 38 makes container 12 easy to move onto remote sites. Container 12 has a drain passageway 40 through peripheral sidewalls 20 adjacent bottom 18. Liquids are periodically drained via drain passageway 40. An overflow outlet pipe 42 is provided adjacent top peripheral edge 28 of container 12. Overflow outlet pipe 42 is intended to provide relief in the event the accumulation of liquids exceeds the capacity of container 12. Overflow outlet pipe 42 is intended for connection to supplemental storage (not shown).

The use and operation of safety flare 10 will now be described with reference to FIG. 1. Burner 32 is connected to a source of waste gas (not shown). The waste gas flows to nozzles 34 where it is ignited. Nozzles 34 are directed downwardly to permit any liquids carried to burner 32 by the waste gas to fall by force of gravity into interior 14 of container 12. Combustion air is provided to burner 32 by vent stack 22. Periodically, container 12 is drained of accumulated liquids via drain passageway 40.

It will be apparent to one skilled in the art that modifications may be made to the illustrated embodiment without departing from the spirit and scope of the invention as defined by the Claims. In particular, the shape of container 12, vent stack 22 and burner 32 may be modified.

The embodiments of the invention in which an exclusive property or privilege is are claimed as follows:

1. A safety flare for combustion of waste gases, comprising:

a. a container having an interior and an exterior, the interior being defined by a bottom and peripheral sidewalls;

b. a vent stack extending through the interior of the container, the vent stack having a first end communicating with the exterior of the container and a second end extending past a top peripheral edge of the peripheral sidewalls of the container;

c. means for permitting the communication of combustion air with the first end of the vent stack; and d. a burner immediately surrounding the second end of the vent stack such that the burner is supplied with combustion air by the vent stack, the burner having a plurality of downwardly directed nozzles such that liquids passing through the nozzles fall by force of gravity into the interior of the container.

2. The safety flare as defined in claim 1, wherein a shroud extends from the top peripheral edge of the container to the burner.

3. The safety flare as defined in claim 1, wherein the container is mounted on a skid assembly.

4. The safety flare as defined in claim 1, wherein the container has a drain passageway through the peripheral sidewalls adjacent the bottom.

5. The safety flare as defined in claim 1, wherein the first end of the vent stack is positioned adjacent the bottom of the container and the container has a plurality of vents adjacent the bottom as means to permit the communication of combustion air with the first end of the vent stack.

6. The safety flare as defined in claim 1, wherein an overflow outlet pipe is provided adjacent the top peripheral edge of the container.

* * * * *